US007090012B2

(12) United States Patent
Hill et al.

(10) Patent No.: US 7,090,012 B2
(45) Date of Patent: Aug. 15, 2006

(54) METHOD AND APPARATUS FOR SUBSURFACE FLUID SAMPLING

(75) Inventors: Bunker M. Hill, Sugar Land, TX (US); Alexander Zazovosky, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/076,567

(22) Filed: Mar. 9, 2005

(65) Prior Publication Data

US 2005/0155760 A1 Jul. 21, 2005

Related U.S. Application Data

(62) Division of application No. 10/184,833, filed on Jun. 28, 2002, now Pat. No. 6,964,301.

(51) Int. Cl.
*E21B 49/08* (2006.01)
*E21B 49/10* (2006.01)

(52) U.S. Cl. ..... 166/264; 166/100; 166/191; 175/59; 73/152.17; 73/152.24

(58) Field of Classification Search ..... 166/264, 166/387, 386, 179, 191, 100, 242.1; 175/58, 175/59, 60; 73/152.17, 152.23, 152.24, 152.46
See application file for complete search history.

(56) References Cited

U.S. PATENT DOCUMENTS 3,121,459 A 2/1964 Van Ness, Jr. et al.
3,323,361 A 6/1967 Lebourg
3,430,711 A 3/1969 Taggart
3,611,799 A 10/1971 Davis
3,924,463 A 12/1975 Urbanosky
3,934,468 A 1/1976 Brieger
4,246,782 A 1/1981 Hallmark
4,287,946 A 9/1981 Brieger
4,339,948 A 7/1982 Hallmark (Continued)

FOREIGN PATENT DOCUMENTS

WO WO96/30628 10/1996

OTHER PUBLICATIONS

Schlumberger Wireline & Testing, Schlumberger Wireline Fomation Testing and Sampling, pp. 4-1 through 10-25, 1996.

(Continued)

*Primary Examiner*—Jennifer H. Gay
(74) *Attorney, Agent, or Firm*—J. L. Jennie Salazar; Victor H. Segura; Brigitte L. Echols

(57) ABSTRACT

The apparatuses and methods herein relate to techniques for extracting fluid from a subsurface formation. A downhole sampling tool is provided with a probe having an internal wall capable of selectively diverting virgin fluids into virgin flow channels for sampling, while diverting contaminated fluids into contaminated flow channels to be discarded. The characteristics of the fluid passing through the channels of the probe may be measured. The data generated during sampling may be sent to a controller capable of generating data, communicating and/or sending command signals. The flow of fluid into the downhole tool may be selectively adjusted to optimize the flow of fluid into the channels by adjusting the internal wall within the probe and/or by adjusting the flow rates through the channels. The configuration of the internal wall and/or the flow rates may be automatically adjusted by the controller and/or manually manipulated to further optimize the fluid flow.

15 Claims, 8 Drawing Sheets

U.S. PATENT DOCUMENTS

| | | | | |
|---|---|---|---|---|
| 4,369,654 | A | 1/1983 | Hallmark | |
| 4,392,376 | A | 7/1983 | Lagus et al. | |
| 4,416,152 | A | 11/1983 | Wilson | |
| 4,513,612 | A | 4/1985 | Shalek | |
| 4,535,843 | A * | 8/1985 | Jageler | 166/250.01 |
| 4,573,532 | A * | 3/1986 | Blake | 166/264 |
| 4,635,717 | A * | 1/1987 | Jageler | 166/250.1 |
| 4,690,216 | A * | 9/1987 | Pritchard, Jr. | 166/264 |
| 4,860,581 | A | 8/1989 | Zimmerman et al. | |
| 4,879,900 | A | 11/1989 | Gilbert | |
| 4,936,139 | A | 6/1990 | Zimmerman et al. | |
| 4,994,671 | A | 2/1991 | Safinya et al. | |
| 5,230,244 | A | 7/1993 | Gilbert | |
| 5,335,542 | A | 8/1994 | Ramakrishnan et al. | |
| 5,337,838 | A | 8/1994 | Sorensen | |
| 5,540,280 | A * | 7/1996 | Schultz et al. | 166/250.07 |
| 5,622,223 | A * | 4/1997 | Vasquez | 166/264 |
| 5,765,637 | A | 6/1998 | Dietle et al. | |
| 5,770,798 | A | 6/1998 | Georgi et al. | |
| 5,799,733 | A * | 9/1998 | Ringgenberg et al. | 166/264 |
| 5,803,186 | A * | 9/1998 | Berger et al. | 175/50 |
| 5,826,662 | A | 10/1998 | Beck et al. | |
| 5,934,374 | A | 8/1999 | Hrametz et al. | |
| 6,164,126 | A | 12/2000 | Ciglenec et al. | |
| 6,176,323 | B1 | 1/2001 | Weirich et al. | |
| 6,178,815 | B1 | 1/2001 | Felling et al. | |
| 6,223,822 | B1 | 5/2001 | Jones | |
| 6,230,557 | B1 | 5/2001 | Ciglenec et al. | |
| 6,301,959 | B1 | 10/2001 | Hrametz et al. | |
| 6,343,507 | B1 * | 2/2002 | Felling et al. | 73/152.19 |
| 6,568,487 | B1 | 5/2003 | Meister et al. | |
| 6,622,554 | B1 * | 9/2003 | Manke et al. | 73/152.55 |
| 6,719,049 | B1 | 4/2004 | Sherwood et al. | |
| 6,722,432 | B1 * | 4/2004 | Spiers et al. | 166/264 |
| 6,877,559 | B1 * | 4/2005 | Hashem | 166/264 |
| 2002/0100585 | A1 * | 8/2002 | Spiers et al. | 166/264 |
| 2003/0234120 | A1 * | 12/2003 | Paluch et al. | 175/50 |
| 2004/0163808 | A1 * | 8/2004 | Ringgenberg et al. | 166/250.16 |

OTHER PUBLICATIONS

Hashem, M.N. et al., Determination of Producible Hydrocarbon Type and Oil Quality in Wells Drilled with Synthetic Oil-Based Muds, SPE Reservoir Eval. & Eng. 2, pp. 125-133, Apr. 1999.

Mullins, Oliver C. et al., Real-Time Determination of Filtrate Contamination During Openhole Wireline Sampling by Optical Spectroscopy, Society of Petroleum Engineers 63071, pp. 1-13, Oct. 1-4, 2000.

Akram, A.H. et al., A Model to Predict Wireline Formation Tester Sample Contamination, Society of Petroleum Engineers 48959, pp. 27-33, Sep. 27-30, 1998.

Hammond, P.S., One- and Two-Phase Flow During Fluid Sampling by a Wireline Tool, Schlumberger Cambridge Research, pp. 299-330, Aug. 1989.

* cited by examiner

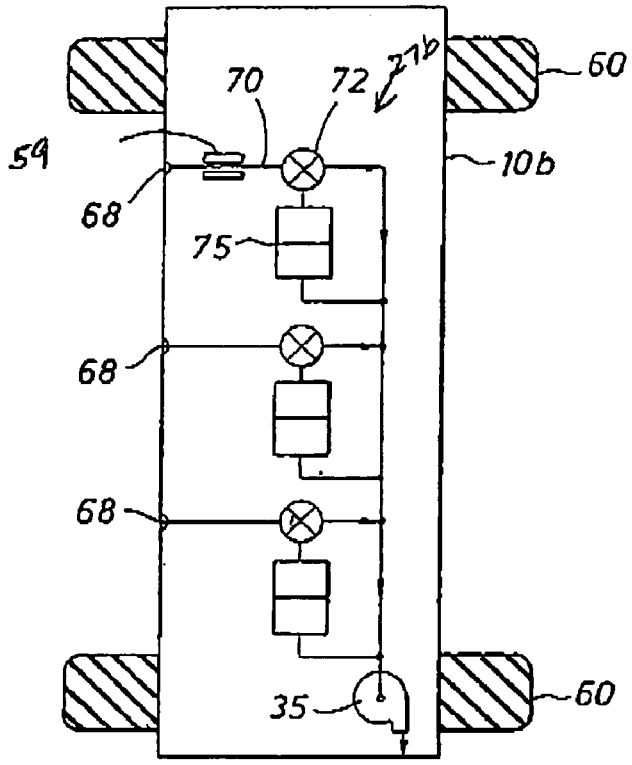
FIG. 8C
FIG. 11B
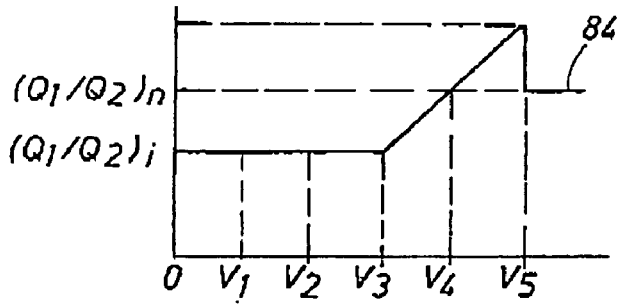
FIG. 10
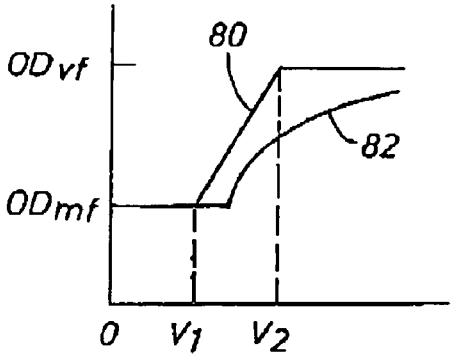
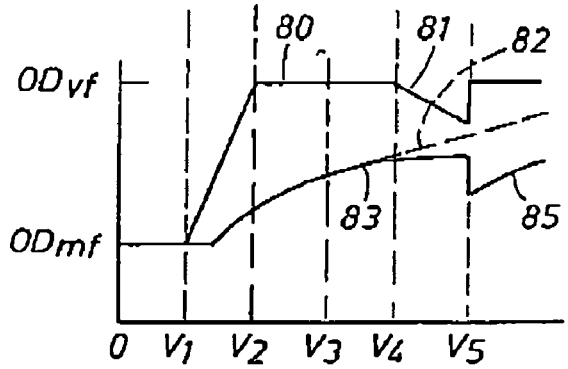
FIG. 11A

METHOD AND APPARATUS FOR SUBSURFACE FLUID SAMPLING

CROSS REFERENCE TO RELATED APPLICATIONS

This application is a divisional of U.S. patent application Ser. No. 10/184,833, filed on Jun. 28, 2002, now U.S. Pat. No. 6,964,301.

TECHNICAL FIELD

The invention relates to apparatus and methods for collecting fluid samples from subsurface formations.

BACKGROUND OF THE INVENTION

The collection and sampling of underground fluids contained in subsurface formations is well known. In the petroleum exploration and recovery industries, for example, samples of formation fluids are collected and analyzed for various purposes, such as to determine the existence, composition and producibility of subsurface hydrocarbon fluid reservoirs. This aspect of the exploration and recovery process can be crucial in developing drilling strategies and impacts significant financial expenditures and savings.

To conduct valid fluid analysis, the fluid obtained from the subsurface formation should possess sufficient purity, or be virgin fluid, to adequately represent the fluid contained in the formation. As used herein, and in the other sections of this patent, the terms "virgin fluid", "acceptable virgin fluid" and variations thereof mean subsurface fluid that is pure, pristine, connate, uncontaminated or otherwise considered in the fluid sampling and analysis field to be sufficiently or acceptably representative of a given formation for valid hydrocarbon sampling and/or evaluation.

Various challenges may arise in the process of obtaining virgin fluid from subsurface formations. Again with reference to the petroleum-related industries, for example, the earth around the borehole from which fluid samples are sought typically contains contaminates, such as filtrate from the mud utilized in drilling the borehole. This material often contaminates the virgin fluid as it passes through the borehole, resulting in fluid that is generally unacceptable for hydrocarbon fluid sampling and/or evaluation. Such fluid is referred to herein as "contaminated fluid." Because fluid is sampled through the borehole, mudcake, cement and/or other layers, it is difficult to avoid contamination of the fluid sample as it flows from the formation and into a downhole tool during sampling. A challenge thus lies in minimizing the contamination of the virgin fluid during fluid extraction from the formation.

FIG. 1 depicts a subsurface formation 16 penetrated by a wellbore 14. A layer of mud cake 15 lines a sidewall 17 of the wellbore 14. Due to invasion of mud filtrate into the formation during drilling, the wellbore is surrounded by a cylindrical layer known as the invaded zone 19 containing contaminated fluid 20 that may or may not be mixed with virgin fluid. Beyond the sidewall of the wellbore and surrounding contaminated fluid, virgin fluid 22 is located in the formation 16. As shown in FIG. 1, contaminates tend to be located near the wellbore wall in the invaded zone 19.

FIG. 2 shows the typical flow patterns of the formation fluid as it passes from subsurface formation 16 into a downhole tool 1. The downhole tool 1 is positioned adjacent the formation and a probe 2 is extended from the downhole tool through the mudcake 15 to the sidewall 17 of the wellbore 14. The probe 2 is placed in fluid communication with the formation 16 so that formation fluid may be passed into the downhole tool 1. Initially, as shown in FIG. 1, the invaded zone 19 surrounds the sidewall 17 and contains contamination. As fluid initially passes into the probe 2, the contaminated fluid 20 from the invaded zone 19 is drawn into the probe with the fluid thereby generating fluid unsuitable for sampling. However, as shown in FIG. 2, after a certain amount of fluid passes through the probe 2, the virgin fluid 22 breaks through and begins entering the probe. In other words, a more central portion of the fluid flowing into the probe gives way to the virgin fluid, while the remaining portion of the fluid is contaminated fluid from the invasion zone. The challenge remains in adapting to the flow of the fluid so that the virgin fluid is collected in the downhole tool during sampling.

Various methods and devices have been proposed for obtaining subsurface fluids for sampling and evaluation. For example, U.S. Pat. No. 6,230,557 to Ciglenec et al., U.S. Pat. No. 6,223,822 to Jones, U.S. Pat. No. 4,416,152 to Wilson, U.S. Pat. No. 3,611,799 to Davis and International Pat. App. Pub. No. WO 96/30628 have developed certain probes and related techniques to improve sampling. Other techniques have been developed to separate virgin fluids during sampling. For example, U.S. Pat. No. 6,301,959 to Hrametz et al. and discloses a sampling probe with two hydraulic lines to recover formation fluids from two zones in the borehole. Borehole fluids are drawn into a guard zone separate from fluids drawn into a probe zone. Despite such advances in sampling, there remains a need to develop techniques for fluid sampling to optimize the quality of the sample and efficiency of the sampling process.

In considering existing technology for the collection of subsurface fluids for sampling and evaluation, there remains a need for apparatus and methods having one or more, among others, of the following attributes: the ability to selectively collect virgin fluid apart from contaminated fluid; the ability to separate virgin fluid from contaminated fluid; the ability to optimize the quantity and/or quality of virgin fluid extracted from the formation for sampling; the ability to adjust the flow of fluid according to the sampling needs; the ability to control the sampling operation manually and/or automatically and/or on a real-time basis. To this end, the present invention seeks to optimize the sampling process.

BRIEF SUMMARY OF THE INVENTION

In one aspect, the present invention relates to a probe deployable from a downhole tool positionable in a wellbore surrounded by a layer of contaminated fluid. The wellbore penetrates a subsurface formation having virgin fluid therein beyond the layer of contaminated fluid. The sampling probe comprises a housing and a sampling intake. The housing is engageable with a sidewall of the wellbore. The housing is also in fluid communication with the subsurface formation whereby the fluids flows from the subterranean formation through the housing and into the downhole tool. The sampling intake is positioned within said housing and in non-engagement with the sidewall of the wellbore. The sampling intake is adapted to receive at least a portion of the virgin fluid flowing through the housing.

In another aspect, the invention relates to a downhole tool useful for extracting fluid from a subsurface formation penetrated by a wellbore surrounded by a layer of contaminated fluid, the subsurface formation having virgin fluid therein beyond the layer of contaminated fluid. The downhole tool comprises a probe carried by the downhole tool.

The probe is positionable in fluid communication with the formation whereby the fluids flow from the subterranean formation through the housing and into the downhole tool. The probe has a wall therein defining a first channel and a second channel. The wall is adjustably positionable within the probe whereby the flow of the virgin fluid through the first channel and into the downhole tool is optimized.

In another aspect of the invention, a downhole tool useful for extracting virgin fluid from a subsurface formation penetrated by a wellbore surrounded by contaminated fluid is provided. The downhole tool comprises a probe, first and second flow lines and at least one pump. The probe is positionable in fluid communication with the formation and has a wall therein defining a first channel and a second channel. The wall is adjustably positionable within the probe whereby the flow of virgin fluid into the first channel is optimized. The first flow line is in fluid communication with the first channel. The second flow line is in fluid communication with the second channel. The pump(s) draw the fluids from the formation into the flow lines.

In another aspect, the invention relates to a method of sampling virgin fluid from a subterranean formation penetrated by a wellbore surrounded by contaminated fluid, the subterranean formation having virgin fluid therein. The method comprises positioning a downhole tool in the wellbore adjacent the subterranean formation, the downhole tool having a probe adapted to draw fluid therein, positioning the probe in fluid communication with the formation, the probe having a wall therein defining a first channel and a second channel, drawing at least a portion of the virgin fluid through the first channel and into the downhole tool, and selectively adjusting the wall within the probe whereby the flow of virgin fluid into the downhole tool is optimized.

In yet another aspect, the invention relates to a method of sampling virgin fluid from a subterranean formation penetrated by a wellbore surrounded by contaminated fluid, the subterranean formation having virgin fluid therein. The method comprises positioning a downhole tool in the wellbore adjacent the subterranean formation, the downhole tool having a probe adapted to draw fluid therein, positioning the probe in fluid communication with the formation, the probe having a wall therein defining a first channel and a second channel, drawing at least a portion of the virgin fluid into the first channel in the probe and selectively adjusting the flow of fluid into the channels whereby the flow of virgin fluid into the probe is optimized.

Another aspect of the invention relates to a downhole tool useful for extracting virgin fluid from a subsurface formation penetrated by a wellbore surrounded by contaminated fluid. The apparatus comprises a probe, a contamination monitor and a controller. The probe is positionable in fluid communication with the formation and adapted to flow the fluids from the formation into the downhole tool. The probe has a wall therein defining a first channel and a second channel. The contamination monitor is adapted to measure fluid parameters in at least one of the channels. The controller is adapted to receive data from the contamination monitor and send command signals in response thereto whereby the wall is selectively adjusted within the probe to optimize the flow of the virgin fluid through the first channel and into the downhole tool.

Another aspect of the invention relates to a downhole tool useful for extracting virgin fluid from a subsurface formation penetrated by a wellbore surrounded by contaminated fluid. The downhole tool comprises a probe, first and second flow lines, at least one pump, a monitor and a controller. The probe is positionable in fluid communication with the formation and adapted to flow the fluids from the formation into the downhole tool. The probe has a wall therein defining a first channel and a second channel. The first flow line is in fluid communication with the first channel. The second flow line is in fluid communication with the second channel. The pump(s) draw the fluids from the formation. The contamination monitor is adapted to measure fluid parameters in at least one of the channels. The controller is adapted to receive data from the contamination monitor and send command signals in response thereto whereby the pump is selectively activated to draw fluid into the flow lines to optimize the flow of the virgin fluid through the first channel and into the downhole tool.

In another aspect, the invention relates to a method of sampling virgin fluid from a subterranean formation penetrated by a wellbore surrounded by contaminated fluid, the subterranean formation having virgin fluid therein. The method comprises positioning a probe in fluid communication with the formation, the probe carried by a downhole tool and having a wall therein defining a first channel and a second channel, flowing the fluids through the probe and into the downhole tool, monitoring fluid parameters of the fluid passing through the probe, and selectively adjusting the flow of fluids into the probe in response to the fluid parameters whereby the flow of virgin fluid through the first channel and into the downhole tool is optimized.

The invention also relates to a downhole apparatus for separating virgin fluid and contaminated fluid extracted from a subsurface formation. The downhole apparatus comprises a fluid sampling probe and means for separating virgin fluid. The fluid sampling probe has first and second pathways in fluid communication with each other and the subsurface formation. The means is capable of separating virgin fluid extracted from the subsurface formation and contaminated fluid extracted from the subsurface formation, whereby separation of the virgin and contaminated fluids occurs within said fluid sampling probe, and whereby contaminated fluid is extracted through said first pathway and virgin fluid is extracted through said second pathway.

Other aspects and advantages of the invention will be apparent from the following description and the appended claims.

BRIEF DESCRIPTION OF THE DRAWINGS

For a detailed description of preferred embodiments of the invention, reference will now be made to the accompanying drawings wherein:

FIG. 8C is a schematic view of the flow section of the downhole tool of FIG. 8A.

FIG. 10 is a graphical depiction of the optical density signatures of fluid entering the probe at a given volume.

FIG. 11A is a graphical depiction of optical density signatures of FIG. 10 deviated during sampling at a given volume.

FIG. 11B is a graphical depiction of the ratio of flow rates corresponding to the given volume for the optical densities of FIG. 11A.

DETAILED DESCRIPTION OF PREFERRED EMBODIMENTS

Figure 1:
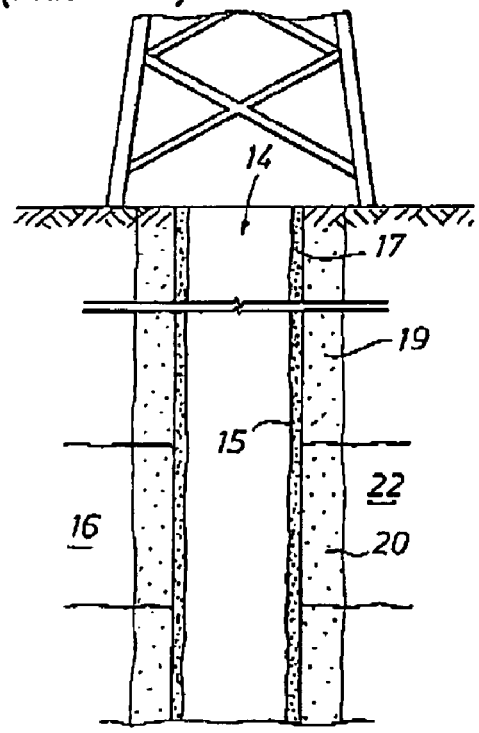
FIG. 1 (PRIOR ART)
FIG. 1 is a schematic view of a subsurface formation penetrated by a wellbore lined with mudcake, depicting the virgin fluid in the subsurface formation.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

Figure 3:
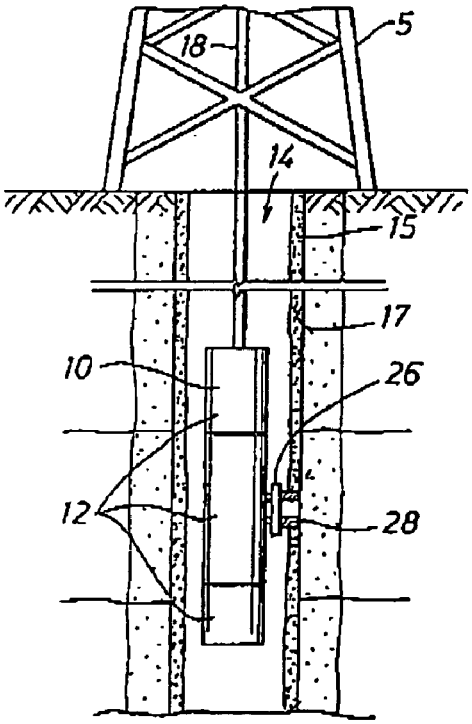
FIG. 3 is a schematic view of down hole wireline tool having a fluid sampling device.

Referring to FIG. 3, an example environment within which the present invention may be used is shown. In the illustrated example, the present invention is carried by a down hole tool 10. An example commercially available tool 10 is the Modular Formation Dynamics Tester (MDT) by Schlumberger Corporation, the assignee of the present application and further depicted, for example, in U.S. Pat. Nos. 4,936,139 and 4,860,581 hereby incorporated by reference herein in their entireties.

The downhole tool 10 is deployable into bore hole 14 and suspended therein with a conventional wire line 18, or conductor or conventional tubing or coiled tubing, below a rig 5 as will be appreciated by one of skill in the art. The illustrated tool 10 is provided with various modules and/or components 12, including, but not limited to, a fluid sampling device 26 used to obtain fluid samples from the subsurface formation 16. The fluid sampling device 26 is provided with a probe 28 extendable through the mudcake 15 and to sidewall 17 of the borehole 14 for collecting samples. The samples are drawn into the downhole tool 10 through the probe 28.

Figure 4:
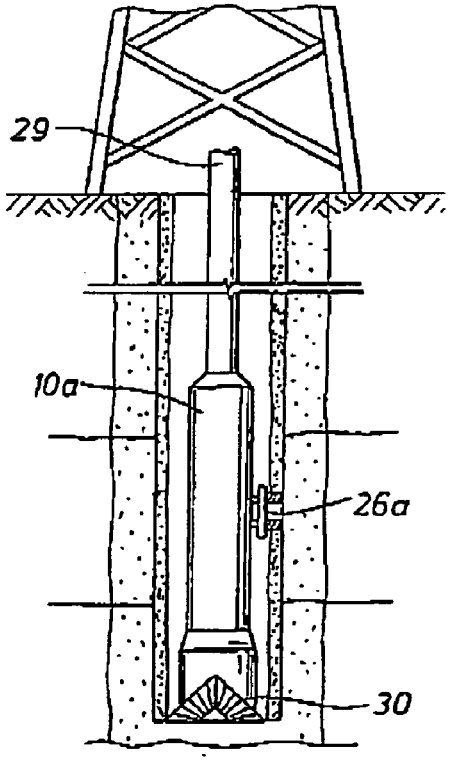
FIG. 4 is a schematic view of a downhole drilling tool with an alternate embodiment of the fluid sampling device of FIG. 3.

While FIG. 3 depicts a modular wireline sampling tool for collecting samples according to the present invention, it will be appreciated by one of skill in the art that such system may be used in any downhole tool. For example, FIG. 4 shows an alternate downhole tool 10*a* having a fluid sampling system 26*a* therein. In this example, the downhole tool 10*a* is a drilling tool including a drill string 29 and a drill bit 30. The downhole drilling tool 10*a* may be of a variety of drilling tools, such as a Measurement-While-Drilling (MWD), Logging-While Drilling (LWD) or other drilling system. The tools 10 and 10*a* of FIGS. 3 and 4, respectively, may have alternate configurations, such as modular, unitary, wireline, coiled tubing, autonomous, drilling and other variations of downhole tools.

Figure 5:
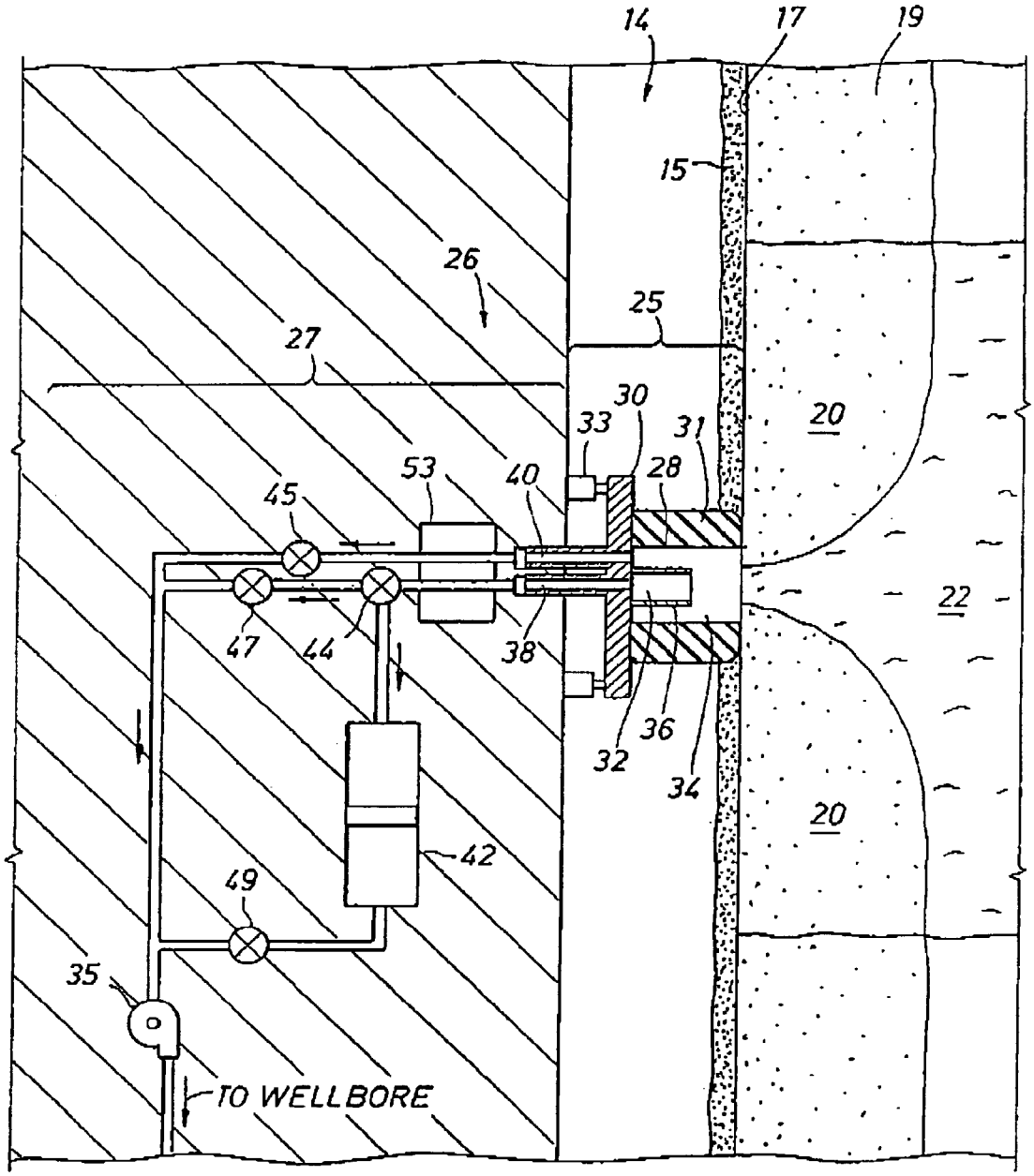
FIG. 5 is a detailed view of the fluid sampling device of FIG. 3 depicting an intake section and a fluid flow section.

Referring now to FIG. 5, the fluid sampling system 26 of FIG. 3 is shown in greater detail. The sampling system 26 includes an intake section 25 and a flow section 27 for selectively drawing fluid into the desired portion of the downhole tool.

The intake section 25 includes a probe 28 mounted on an extendable base 30 having a seal 31, such as a packer, for sealingly engaging the borehole wall 17 around the probe 28. The intake section 25 is selectively extendable from the downhole tool 10 via extension pistons 33. The probe 28 is provided with an interior channel 32 and an exterior channel 34 separated by wall 36. The wall 36 is preferably concentric with the probe 28. However, the geometry of the probe and the corresponding wall may be of any geometry. Additionally, one or more walls 36 may be used in various configurations within the probe.

The flow section 27 includes flow lines 38 and 40 driven by one or more pumps 35. A first flow line 38 is in fluid communication with the interior channel 32, and a second flow line 40 is in fluid communication with the exterior channel 34. The illustrated flow section may include one or more flow control devices, such as the pump 35 and valves 44, 45, 47 and 49 depicted in FIG. 5, for selectively drawing fluid into various portions of the flow section 27. Fluid is drawn from the formation through the interior and exterior channels and into their corresponding flow lines.

Preferably, contaminated fluid may be passed from the formation through exterior channel 34, into flow line 40 and discharged into the wellbore 14. Preferably, fluid passes from the formation into the interior channel 32, through flow line 38 and either diverted into one or more sample chambers 42, or discharged into the wellbore. Once it is determined that the fluid passing into flow line 38 is virgin fluid, a valve 44 and/or 49 may be activated using known control techniques by manual and/or automatic operation to divert fluid into the sample chamber.

The fluid sampling system 26 is also preferably provided with one or more fluid monitoring systems 53 for analyzing the fluid as it enters the probe 28. The fluid monitoring system 53 may be provided with various monitoring devices, such as optical fluid analyzers, as will be discussed more fully herein.

The details of the various arrangements and components of the fluid sampling system 26 described above as well as alternate arrangements and components for the system 26 would be known to persons skilled in the art and found in various other patents and printed publications, such as, those discussed herein. Moreover, the particular arrangement and components of the downhole fluid sampling system 26 may vary depending upon factors in each particular design, or use, situation. Thus, neither the system 26 nor the present invention are limited to the above described arrangements and components and may include any suitable components and arrangement. For example, various flow lines, pump placement and valving may be adjusted to provide for a variety of configurations. Similarly, the arrangement and components of the downhole tool 10 may vary depending upon factors in each particular design, or use, situation. The above description of exemplary components and environments of the tool 10 with which the fluid sampling device 26 of the present invention may be used is provided for illustrative purposes only and is not limiting upon the present invention.

With continuing reference to FIG. 5, the flow pattern of fluid passing into the downhole tool 10 is illustrated. Initially, as shown in FIG. 1, an invaded zone 19 surrounds the borehole wall 17. Virgin fluid 22 is located in the formation 16 behind the invaded zone 19. At some time during the process, as fluid is extracted from the formation 16 into the probe 28, virgin fluid breaks through and enters the probe 28 as shown in FIG. 5. As the fluid flows into the probe, the contaminated fluid 22 in the invaded zone 19 near the interior channel 32 is eventually removed and gives way to the virgin fluid 22. Thus, only virgin fluid 22 is drawn into the interior channel 32, while the contaminated fluid 20 flows into the exterior channel 34 of the probe 28. To enable such result, the flow patterns, pressures and dimensions of the probe may be altered to achieve the desired flow path as will be described more fully herein.

Figure 6A:
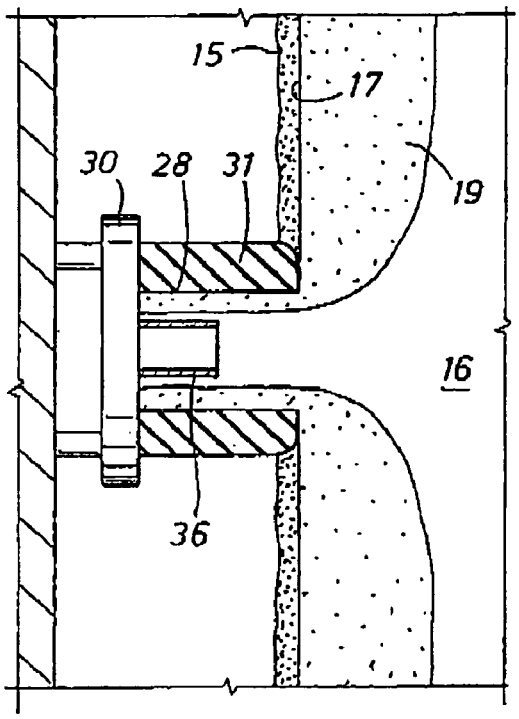
FIG. 6A is a detailed view of the intake section of FIG. 5 depicting the flow of fluid into a probe having a wall defining an interior channel, the wall recessed within the probe.

Referring now to FIGS. 6A–6J, various embodiments of the probe 28 are shown in greater detail. In FIG. 6A, the base 30 is shown supporting the seal 31 in sealing engagement with the borehole wall 17. The probe 28 preferably extends beyond the seal 31 and penetrates the mudcake 15. The probe 28 is placed in fluid communication with the formation 16.

The wall 36 is preferably recessed a distance within the probe 28. In this configuration, pressure along the formation wall is automatically equalized in the interior and exterior channels. The probe 28 and the wall 36 are preferably concentric circles, but may be of alternate geometries depending on the application or needs of the operation. Additional walls, channels and/or flow lines may be incorporated in various configurations to further optimize sampling.

Figure 6B:
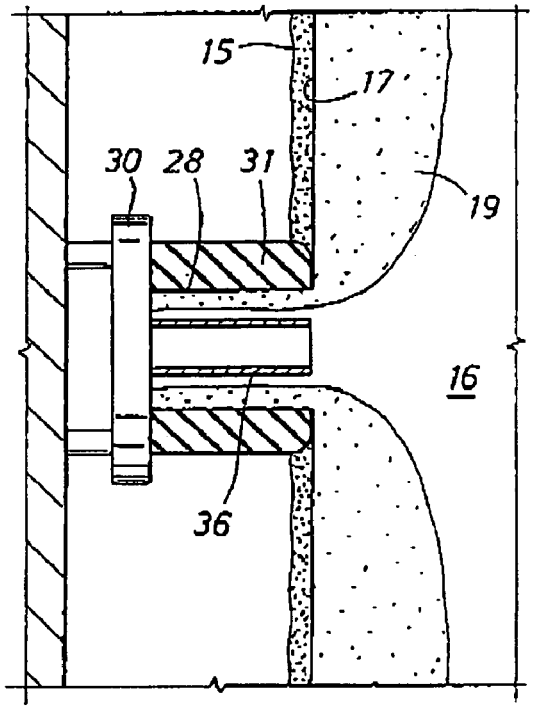
FIG. 6B is an alternate embodiment of the probe of FIG. 6A having a wall defining an interior channel, the wall flush with the probe.

The wall 36 is preferably adjustable to optimize the flow of virgin fluid into the probe. Because of varying flow conditions, it is desirable to adjust the position of the wall 36 so that the maximum amount of virgin fluid may be collected with the greatest efficiency. For example, the wall 36 may be moved or adjusted to various depths relative to the probe 28. As shown in FIG. 6B, the wall 36 may be positioned flush with the probe. In this configuration, the pressure in the interior channel along the formation may be different from the pressure in the exterior channel along the formation.

Figure 6C:
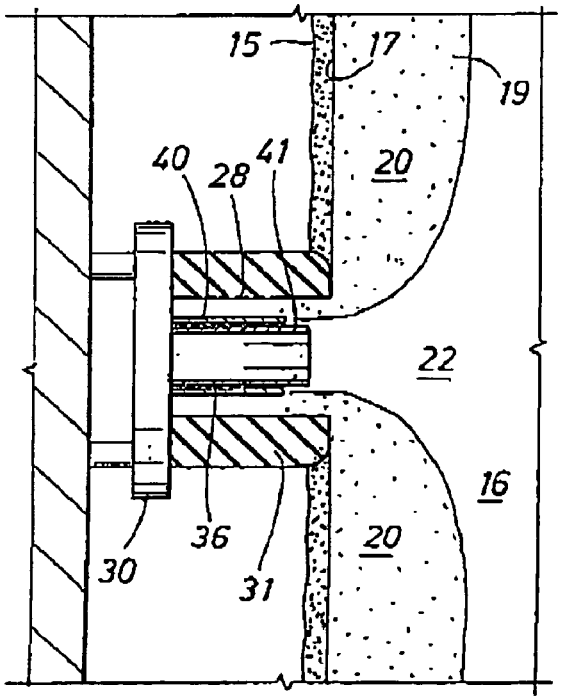
FIG. 6C is an alternate embodiment of the probe of FIG. 6A having a sizer capable of reducing the size of the interior channel.
Figure 6D:
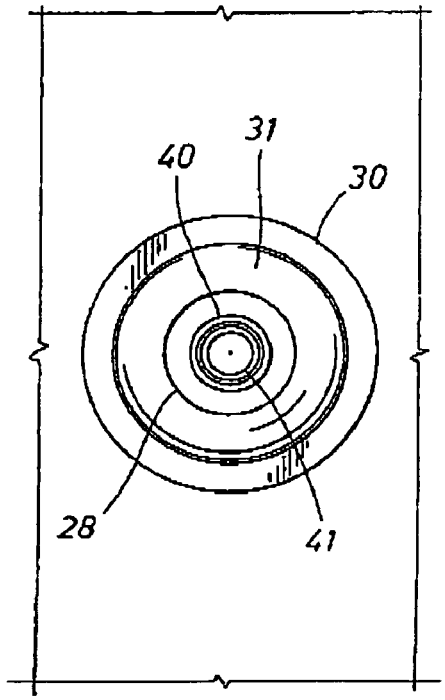
FIG. 6D is a cross-sectional view of the probe of FIG. 6C.
Figure 6E:
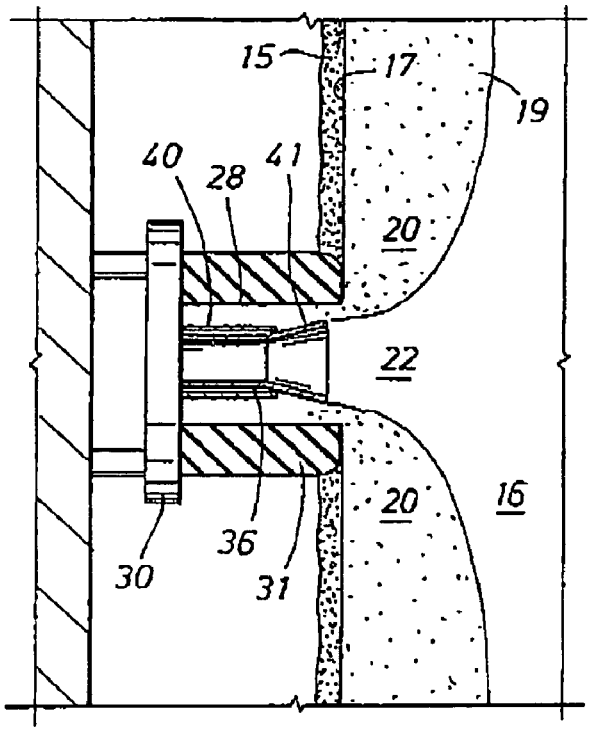
FIG. 6E is an alternate embodiment of the probe of FIG. 6A having a sizer capable of increasing the size of the interior channel.
Figure 6F:
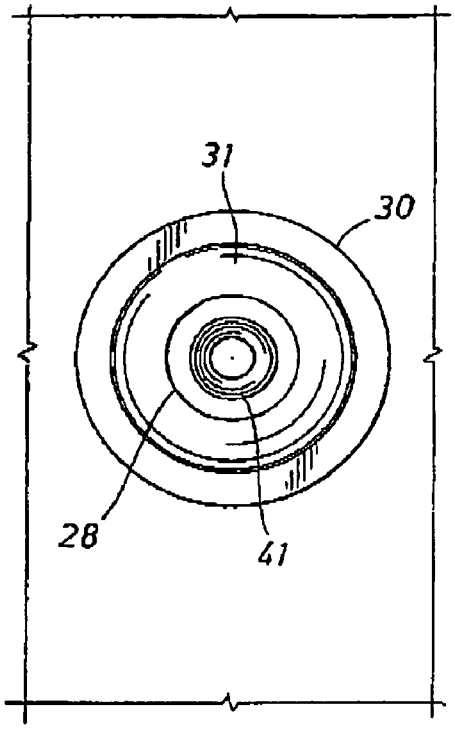
FIG. 6F is a cross-sectional view of the probe of FIG. 6E.

Referring now to FIGS. 6C–6H, the wall 36 is preferably capable of varying the size and/or orientation of the interior channel 32. As shown in FIG. 6C through 6F, the diameter of a portion or all of the wall 36 is preferably adjustable to align with the flow of contaminated fluid 20 from the invaded zone 19 and/or the virgin fluid 22 from the formation 16 into the probe 28. The wall 36 may be provided with a mouthpiece 41 and a guide 40 adapted to allow selective modification of the size and/or dimension of the interior channel. The mouthpiece 41 is selectively movable between an expanded and a collapsed position by moving the guide 40 along the wall 36. In FIGS. 6C and 6D, the guide 40 is surrounds the mouthpiece 41 and maintains it in the collapsed position to reduce the size of the interior flow channel in response to a narrower flow of virgin fluid 22. In FIGS. 6E and 6F, the guide 41 is retracted so that the mouthpiece 41 is expanded to increase the size of the interior flow channel in response to a wider flow of virgin fluid 22.

The mouthpiece depicted in FIGS. 6C–6F may be a folded metal spring, a cylindrical bellows, a metal energized elastomer, a seal, or any other device capable of functioning to selectively expand or extend the wall as desired. Other devices capable of expanding the cross-sectional area of the wall 36 may be envisioned. For example, an expandable spring cylinder pinned at one end may also be used.

Figure 6G:
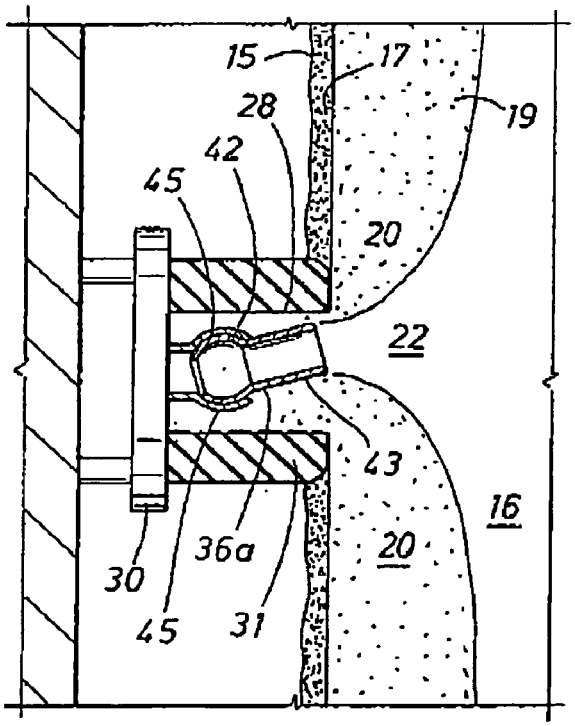
FIG. 6G is an alternate embodiment of the probe of FIG. 6A having a pivoter that adjusts the position of the interior channel within the probe.
Figure 6H:
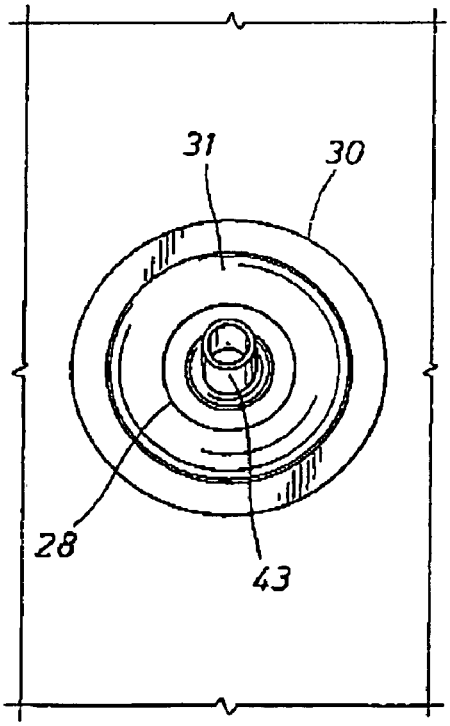
FIG. 6H is a cross-sectional view of the probe of FIG. 6G.

As shown in FIGS. 6G and 6H, the probe 28 may also be provided with a wall 36*a* having a first portion 42, a second portion 43 and a seal bearing 45 therebetween to allow selective adjustment of the orientation of the wall 36*a* within the probe. The second portion 43 is desirably movable within the probe 28 to locate an optimal alignment with the flow of virgin fluid 20.

Figure 6I:
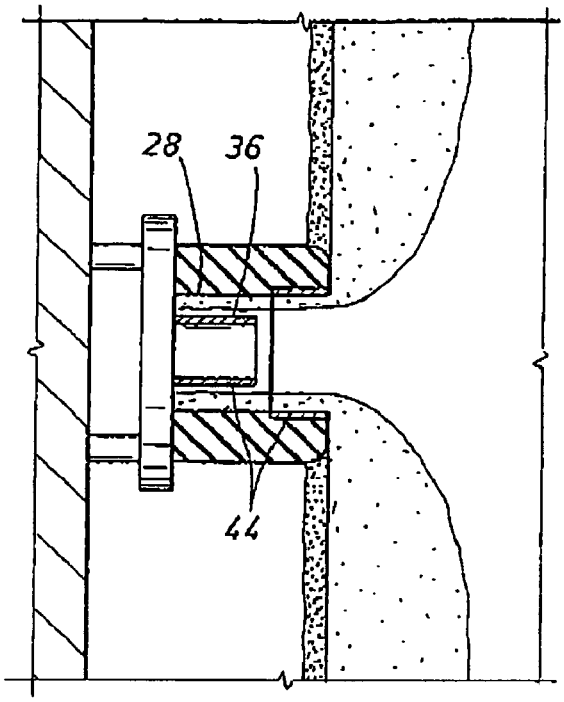
FIG. 6I is an alternate embodiment of the probe of FIG. 6A having a shaper that adjusts the shape of the probe and/or interior channel.
Figure 6J:
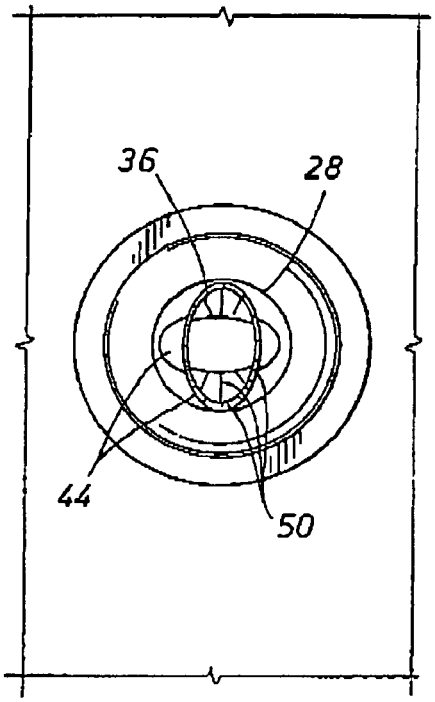
FIG. 6J is a cross-sectional view of the probe of FIG. 6I.

Additionally, as shown in FIGS. 6I and 6J, one or more shapers 44 may also be provided to conform the probe 28 and/or wall 36 into a desired shape. The shapers 44 have two more fingers 50 adapted to apply force to various positions about the probe and/or wall 36 causing the shape to deform. When the probe 40 and or wall 36 are extended as depicted in FIG. 6E, the shaper 44 may be extended about at least a portion of the mouthpiece 41 to selectively deform the mouthpiece to the desired shape. If desired, the shapers apply pressure to various positions around the probe and/or wall to generate the desired shape.

The sizer, pivoter and/or shaper may be any electronic mechanism capable of selectively moving the wall 36 as provided herein. One or more devices may be used to perform one or more of the adjustments. Such devices may include a selectively controllable slidable collar, a pleated tube, or cylindrical bellows or spring, an elastomeric ring with embedded spring-biased metal fingers, a flared elastomeric tube, a spring cylinder, and/or any suitable components with any suitable capabilities and operation may be used to provide any desired variability.

These and other adjustment devices may be used to alter the channels for fluid flow. Thus, a variety of configurations may be generated by combining one or more of the adjustable features.

Figure 7A:
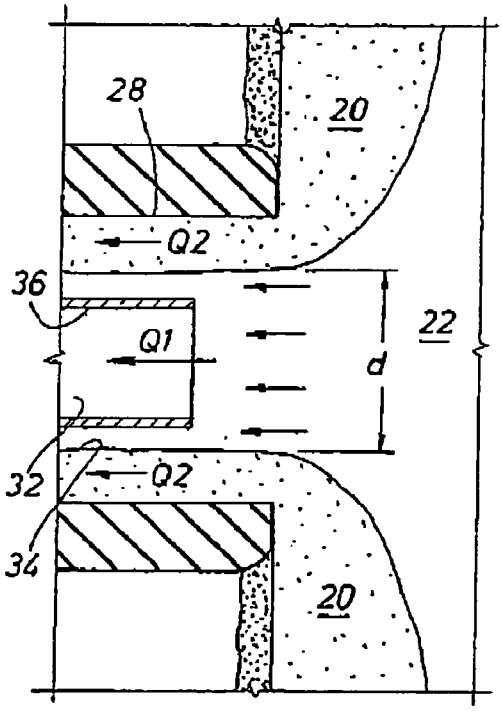
FIG. 7A is a schematic view of the probe of FIG. 6A with the flow of fluid from the formation into the probe with the pressure and/or flow rate balanced between the interior and exterior flow channels for substantially linear flow into the probe.
Figure 7B:
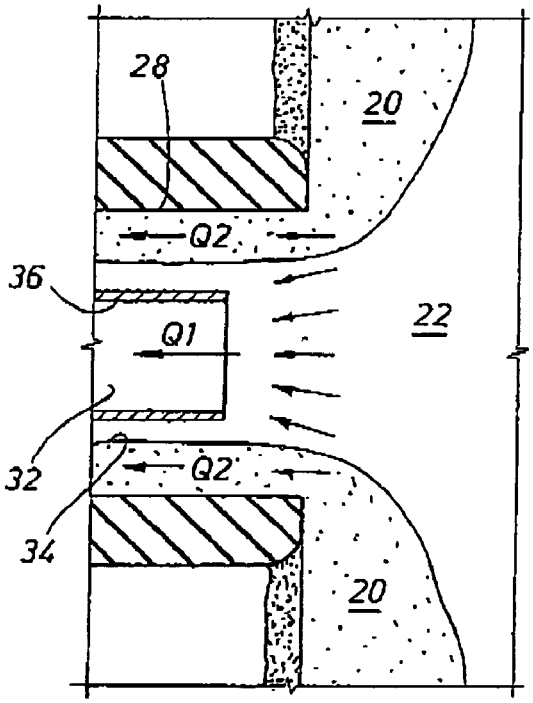
FIG. 7B is a schematic view of the probe of FIG. 7A with the flow rate of the interior channel greater than the flow rate of the exterior channel.

Now referring to FIGS. 7A and 7B, the flow characteristics are shown in greater detail. Various flow characteristics of the probe 28 may be adjusted. For example, as shown in FIG. 7A, the probe 28 may be designed to allow controlled flow separation of virgin fluid 22 into the interior channel 32 and contaminated fluid 20 into the exterior channel 34. This may be desirable, for example, to assist in minimizing the sampling time required before acceptable virgin fluid is flowing into the interior channel 32 and/or to optimize or increase the quantity of virgin fluid flowing into the interior channel 32, or other reasons.

The ratio of fluid flow rates within the interior channel 32 and the exterior channel 34 may be varied to optimize, or increase, the volume of virgin fluid drawn into the interior channel 32 as the amount of contaminated fluid 20 and/or virgin fluid 22 changes over time. The diameter d of the area of virgin fluid flowing into the probe may increase or decrease depending on wellbore and/or formation conditions. Where the diameter d expands, it is desirable to increase the amount of flow into the interior channel. This may be done by altering the wall 36 as previously described. Alternatively or simultaneously, the flow rates to the respective channels may be altered to further increase the flow of virgin fluid into the interior channel.

The comparative flow rate into the channels 32 and 34 of the probe 28 may be represented by a ratio of flow rates $Q_1/Q_2$. The flow rate into the interior channel 32 is represented by $Q_1$ and the flow rate in the exterior channel 34 is represented by $Q_2$. The flow rate $Q_1$ in the interior channel 32 may be selectively increased and/or the flow rate $Q_2$ in the exterior channel 34 may be decreased to allow more fluid to be drawn into the interior channel 32. Alternatively, the flow rate $Q_1$ in the interior channel 32 may be selectively decreased and/or the flow rate ($Q_2$) in the exterior channel 34 may be increased to allow less fluid to be drawn into the interior channel 32.

As shown in FIG. 7A, $Q_1$ and $Q_2$ represent the flow of fluid through the probe 28. The flow of fluid into the interior channel 32 may be altered by increasing or decreasing the flow rate to the interior channel 32 and/or the exterior channel 34. For example, as shown in FIG. 7B, the flow of fluid into the interior channel 32 may be increased by increasing the flow rate $Q_1$ through the interior channel 32, and/or by decreasing the flow rate $Q_2$ through the exterior channel 34. As indicated by the arrows, the change in the ratio $Q_1/Q_2$ steers a greater amount of the fluid into the interior channel 32 and increases the amount of virgin fluid drawn into the downhole tool (FIG. 5).

The flow rates within the channels 32 and 34 may be selectively controllable in any desirable manner and with any suitable component(s). For example, one or more flow control device 35 is in fluid communication with each flowline 38, 40 may be activated to adjust the flow of fluid into the respective channels (FIG. 5). The flow control 35 and valves 45, 47 and 49 of this example can, if desired, be actuated on a real-time basis to modify the flow rates in the channels 32 and 34 during production and sampling.

The flow rate may be altered to affect the flow of fluid and optimize the intake of virgin fluid into the downhole tool. Various devices may be used to measure and adjust the rates to optimize the fluid flow into the tool. Initially, it may be desirable to have increased flow into the exterior channel when the amount of contaminated fluid is high, and then adjust the flow rate to increase the flow into the interior channel once the amount of virgin fluid entering the probe increases. In this manner, the fluid sampling may be manipulated to increase the efficiency of the sampling process and the quality of the sample.

Figure 8B:
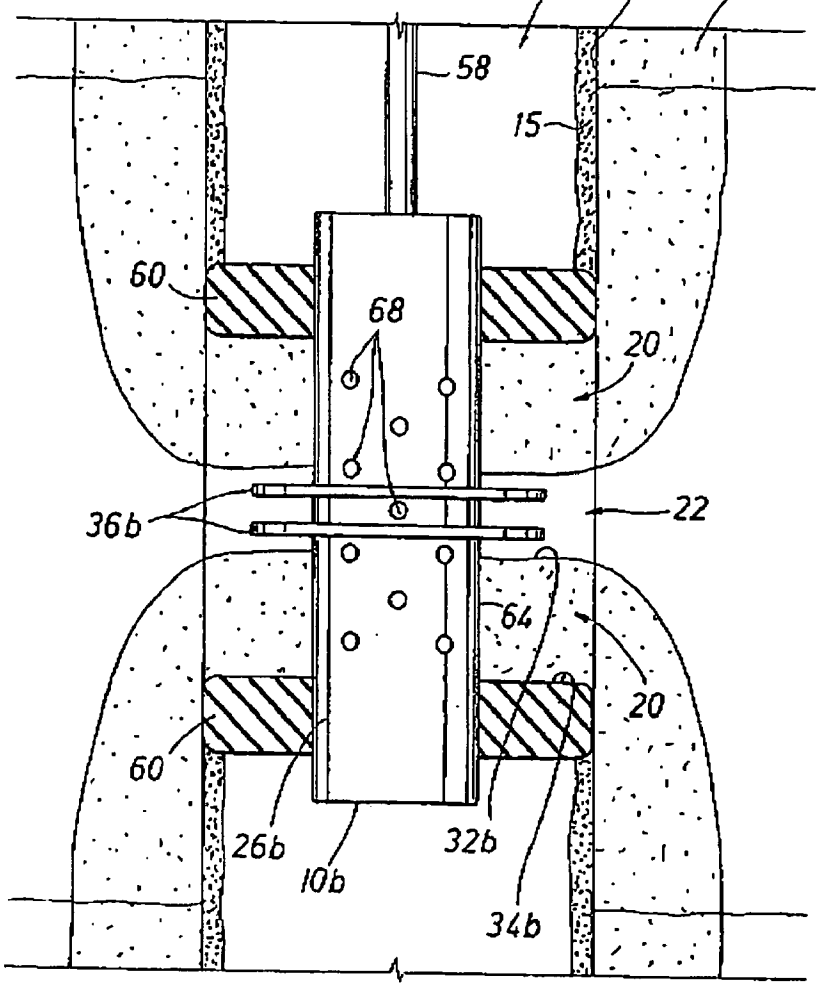
FIG. 8B is a schematic view of the downhole tool of FIG. 8A with the walls moved together in response to changes in the fluid flow.
Figure 8A:
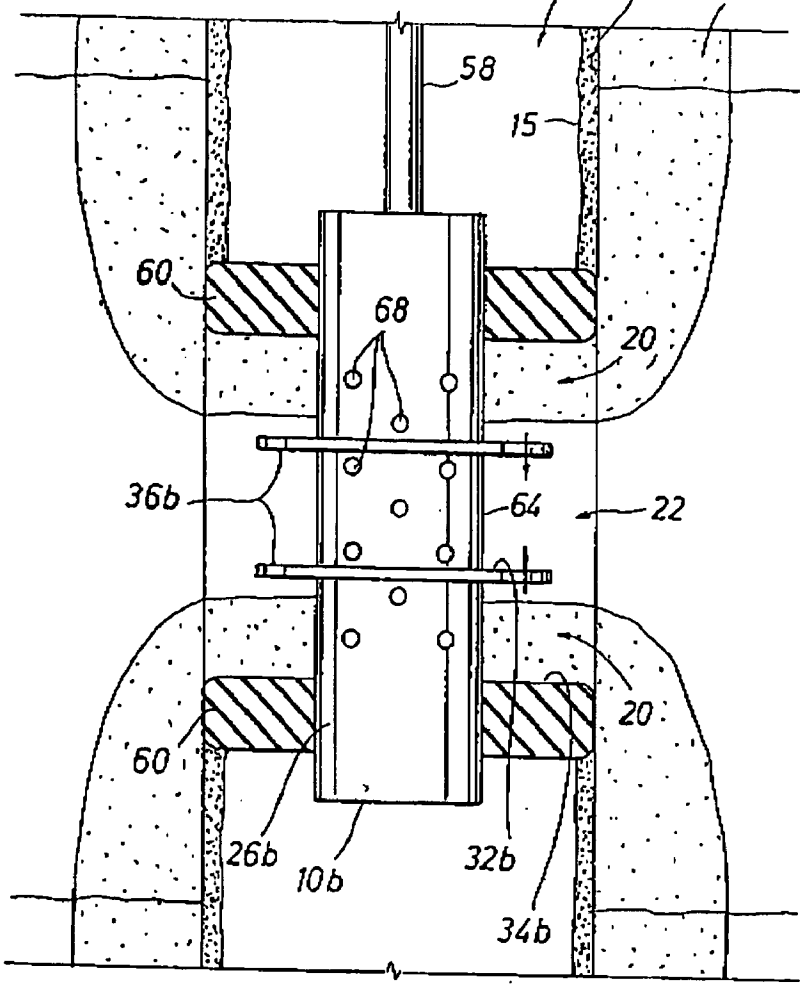
FIG. 8A is a schematic view of an alternate embodiment of the downhole tool and fluid flowing system having dual packers and walls.

Referring now to FIGS. 8A and 8B, another embodiment of the present invention employing a fluid sampling system 26*b* is depicted. A downhole tool 10*b* is deployed into wellbore 14 on coiled tubing 58. Dual packers 60 extend from the downhole tool 10*b* and sealingly engage the sidewall 17 of the wellbore 14. The wellbore 14 is lined with mud cake 15 and surrounded by an invaded zone 19. A pair of cylindrical walls or rings 36*b* are preferably positioned between the packers 60 for isolation from the remainder of the wellbore 14. The packers 60 may be any device capable of sealing the probe from exposure to the wellbore, such as packers or any other suitable device.

The walls 36*b* are capable of separating fluid extracted from the formation 16 into at least two flow channels 32*b* and 34*b*. The tool 10*b* includes a body 64 having at least one fluid inlet 68 in fluid communication with fluid in the wellbore between the packers 60. The walls 36*b* are positioned about the body 64. As indicated by the arrows, the walls 36*b* are axially movable along the tool. Inlets positioned between the walls 36 preferably capture virgin fluid 22, while inlets outside the walls 36 preferably draw in contaminated fluid 20.

The walls 36*b* are desirably adjustable to optimize the sampling process. The shape and orientation of the walls 36*b* may be selectively varied to alter the sampling region. The distance between the walls 36*b* and the borehole wall 17, may be varied, such as by selectively extending and retracting the walls 36*b* from the body 64. The position of the walls 36*b* may be along the body 64. The position of the walls along the body 64 may to moved apart to increase the number of intakes 68 receiving virgin fluid, or moved together to reduce the number of intakes receiving virgin fluid depending on the flow characteristics of the formation. The walls 36*b* may also be centered about a given position along the tool 10*b* and/or a portion of the borehole 14 to align certain intakes 68 with the flow of virgin fluid 22 into the wellbore 14 between the packers 60.

The position of the movement of the walls along the body may or may not cause the walls to pass over intakes. In some embodiments, the intakes may be positioned in specific regions about the body. In this case, movement of the walls along the body may redirect flow within a given area between the packers without having to pass over intakes. The size of the sampling region between the walls 36*b* may be selectively adjusted between any number of desirable positions, or within any desirable range, with the use of any suitable component(s) and technique(s).

An example of a flow system 27*b* for selectively drawing fluid into the downhole tool is depicted in FIG. 8C. A fluid flow line 70 extends from each intake 68 into the downhole tool 10*b* and has a corresponding valve 72 for selectively diverting fluid to either a sample chamber 75 or into the wellbore outside of the packers 60. One or more pumps 35 may be used in coordination with the valves 72 to selectively draw fluid in at various rates to control the flow of fluid into the downhole tool. Contaminated fluid is preferably dispersed back to the wellbore. However, where it is determined that virgin fluid is entering a given intake, a valve 72 corresponding to the intake may be activated to deliver the virgin fluid to a sample chamber 75. Various measurement devices, such as an OFA 59 may be used to evaluate the fluid drawn into the tool. Where multiple intakes are used, specific intakes may be activated to increase the flow nearest the central flow of virgin fluid, while intakes closer to the contaminated region may be decreased to effectively steer the highest concentration of virgin fluid into the downhole tool for sampling.

One or more probes 28 as depicted in any of FIGS. 3–6J may also be used in combination with the probe 28*b* of FIGS. 8A or 8B.

Figure 9:
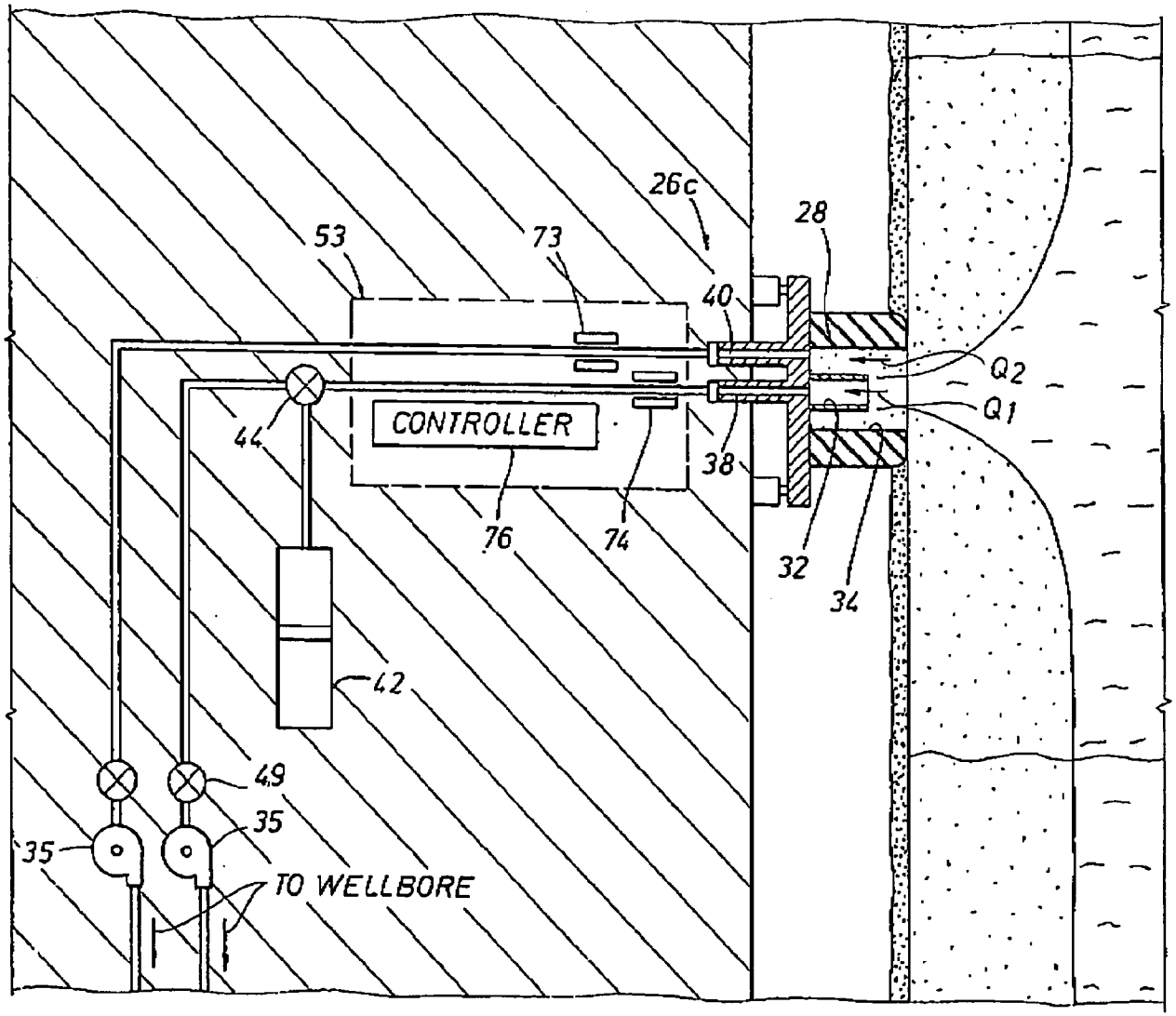
FIG. 9 is a schematic view of the fluid sampling device of FIG. 5 having flow lines with individual pumps.

Referring to FIG. 9, another view of the fluid sampling system 26*c* of FIG. 5 is shown. In FIG. 9, the flow lines 38 and 40 each have a pump 35 for selectively drawing fluid into the channels 32 and 34 of the probe 28.

The fluid monitoring system 53 of FIG. 5 is shown in greater detail in FIG. 9. The flow lines 38 and 40 each pass through the fluid monitoring system 53 for analysis therein. The fluid monitoring system 53 is provided with an optical fluid analyzer 73 for measuring optical density in flow line 40 and an optical fluid analyzer 74 for measuring optical density in flow line 38. The optical fluid analyzer may be a device such as the analyzer described in U.S. Pat. Nos. 6,178,815 to Felling et at and/or U.S. Pat. No. 4,994,671 to Safinya et al., both of which are hereby incorporated by reference.

While the fluid monitoring system 53 of FIG. 9 is depicted as having an optical fluid analyzer for monitoring the fluid, it will be appreciated that other fluid monitoring devices, such as gauges, meters, sensors and/or other measurement or equipment incorporating for evaluation, may be used for determining various properties of the fluid, such as temperature, pressure, composition, contamination and/or other parameters known by those of skill in the art.

A controller 76 is preferably provided to take information from the optical fluid analyzer(s) and send signals in response thereto to alter the flow of fluid into the interior channel 32 and/or exterior channel 34 of the probe 28. As depicted in FIG. 9, the controller is part of the fluid monitoring system 53; however, it will be appreciated by one of skill in the art that the controller may be located in other parts of the downhole tool and/or surface system for operating various components within the wellbore system.

The controller is capable of performing various operations throughout the wellbore system. For example, the controller is capable of activating various devices within the downhole tool, such as selectively activating the sizer, pivoter, shaper and/or other probe device for altering the flow of fluid into the interior and/or exterior channels 32, 34 of the probe. The controller may be used for selectively activating the pumps 35 and/or valves 44, 45, 47, 49 for controlling the flow rate into the channels 32, 34, selectively activating the pumps 35 and/or valves 44, 45, 47, 49 to draw fluid into the sample chamber(s) and/or discharge fluid into the wellbore, to collect and/or transmit data for analysis uphole and other functions to assist operation of the sampling process. The controller may also be used for controlling fluid extracted from the formation, providing accurate contamination parameter values useful in a contamination monitoring model, adding certainty in determining when extracted fluid is virgin fluid sufficient for sampling, enabling the collection of improved quality fluid for sampling, reducing the time required to achieve any of the above, or any combination thereof. However, the contamination monitoring calibration capability can be used for any other suitable purpose(s). Moreover, the use(s) of, or reasons for using, a contamination monitoring calibration capability are not limiting upon the present invention.

An example of optical density (OD) signatures generated by the optical fluid analyzers 73 and 74 of FIG. 9 is shown in FIG. 10. FIG. 10 shows the relationship between OD and the total volume V of fluid as it passes into the interior and exterior channels of the probe. The OD of the fluid flowing through the interior channel 32 is depicted by line 80. The OD of the fluid flowing through the exterior channel 34 is depicted as line 82. The resulting signatures represented by lines 80 and 82 may be used to calibrate future measurements.

Figure 2:
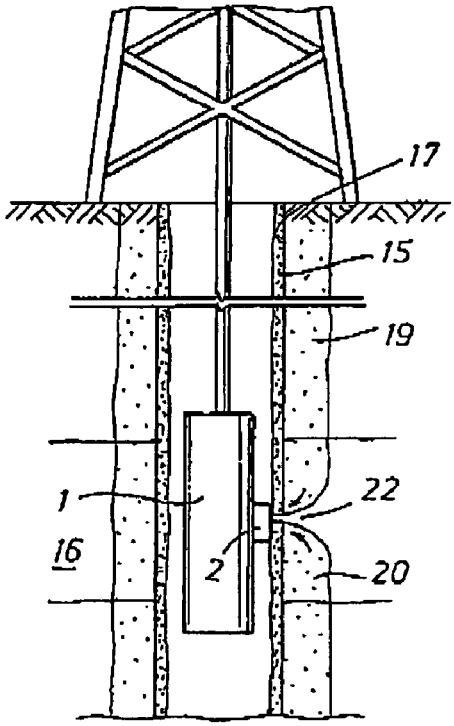
FIG. 2 (PRIOR ART)
FIG. 2 is a schematic view of a down hole tool positioned in the wellbore with a probe extending to the formation, depicting the flow of contaminated and virgin fluid into a downhole sampling tool.

Initially, the OD of fluid flowing into the channels is at $OD_{mf}$. $OD_{mf}$ represents the OD of the contaminated fluid adjacent the wellbore as depicted in FIG. 1. Once the volume of fluid entering the interior channel reaches $V_1$, virgin fluid breaks through. The OD of the fluid entering into the channels increases as the amount of virgin fluid entering into the channels increases. As virgin fluid enters the interior channel 32, the OD of the fluid entering into the interior channel increases until it reaches a second plateau at $V_2$ represented by $OD_{vf}$. While virgin fluid also enters the exterior channel 34, most of the contaminated fluid also continues to enter the exterior channel. The OD of fluid in the exterior channel as represented by line 82, therefore, increases, but typically does not reach the $OD_{vf}$ due to the presence of contaminates. The breakthrough of virgin fluid and flow of fluid into the interior and exterior channels is previously described in relation to FIG. 2.

The distinctive signature of the OD in the internal channel may be used to calibrate the monitoring system or its device. For example, the parameter $OD_{vf}$, which characterizes the optical density of virgin fluid can be determined. This parameter can be used as a reference for contamination monitoring. The data generated from the fluid monitoring system may then be used for analytical purposes and as a basis for decision making during the sampling process.

By monitoring the coloration generated at various optical channels of the fluid monitoring system 53 relative to the curve 80, one can determine which optical channel(s) provide the optimum contrast readout for the optical densities $OD_{mf}$ and $OD_{vf}$. These optical channels may then be selected for contamination monitoring purposes.

FIGS. 11A and 11B depict the relationship between the OD and flow rate of fluid into the probe. FIG. 11A shows the OD signatures of FIG. 10 that has been adjusted during sampling. As in FIG. 10, line 82 shows the signature of the OD of the fluid entering the interior channel 32, and 82 shows the signature of the OD of the fluid entering the exterior channel 34. However, FIG. 11A further depicts evolution of the OD at volumes $V_3$, $V_4$ and $V_5$ during the sampling process.

FIG. 11B shows the relationship between the ratio of flow rates $Q_1/Q_2$ to the volume of fluid that enters the probe. As depicted in FIG. 7A, $Q_1$ relates to the flow rate into the interior channel 32, and $Q_2$ relates to the flow rate into the exterior channel 34 of the probe 28. Initially, as mathematically depicted by line 84 of FIG. 11B, the ratio of flow $Q_1/Q_2$ is at a given level $(Q_1/Q_2)_i$ corresponding to the flow ratio of FIG. 7A. However, the ratio $Q_1/Q_2$ can then be gradually increased, as described with respect to FIG. 7B, so that the ratio of $Q_1/Q_2$ increases. This gradual increase in flow ratio is mathematically depicted as the line 84 increases to the level $(Q_1/Q_2)_n$ at a given volume, such as $V_4$. As depicted in FIG. 11B, the ratio can be further increased up to $V_5$.

As the ratio of flow rate increases, the corresponding OD of the interior channel 32 represented by lines 80 shifts to deviation 81, and the OD of the exterior channel 34 represented by line 82 shifts to deviations 83 and 85. The shifts in the ratio of flow depicted in FIG. 11B correspond to shifts in the OD depicted in FIG. 11A for volumes $V_1$ through $V_5$. An increase in the flow rate ratio at $V_3$ (FIG. 11B) shifts the OD of the fluid flowing into the exterior channel from its expected path 82 to a deviation 83 (FIG. 11B). A further increase in ratio as depicted by line 84 at $V_4$ (FIG. 11A), causes a shift in the OD of line 80 from its reference level $OD_{vf}$ to a deviation 81 (FIG. 11B). The deviation of the OD of line 81 at $V_4$, causes the OD of line 80 to return to its reference level $OD_{vf}$ at $V_5$, while the OD of deviation 83 drops further along deviation 85. Further adjustments to OD and/or ratio may be made to alter the flow characteristics of the sampling process.

It should also be understood that the discussion and various examples of methods and techniques described above need not include all of the details or features described above. Further, neither the methods described above, nor any methods which may fall within the scope of any of the appended claims, need be performed in any particular order. Yet further, the methods of the present invention do not require use of the particular embodiments shown and described in the present specification, such as, for example, the exemplary probe 28 of FIG. 5, but are equally applicable with any other suitable structure, form and configuration of components.

Preferred embodiments of the present invention are thus well adapted to carry out one or more of the objects of the invention. Further, the apparatus and methods of the present invention offer advantages over the prior art and additional capabilities, functions, methods, uses and applications that have not been specifically addressed herein but are, or will become, apparent from the description herein, the appended drawings and claims.

While preferred embodiments of this invention have been shown and described, many variations, modifications and/or changes of the apparatus and methods of the present invention, such as in the components, details of construction and operation, arrangement of parts and/or methods of use, are possible, contemplated by the applicant, within the scope of the appended claims, and may be made and used by one of ordinary skill in the art without departing from the spirit or teachings of the invention and scope of appended claims. Because many possible embodiments may be made of the present invention without departing from the scope thereof, it is to be understood that all matter herein set forth or shown in the accompanying drawings is to be interpreted as illustrative and not limiting. Accordingly, the scope of the invention and the appended claims is not limited to the embodiments described and shown herein.

It should be understood that before any action is taken with respect to any apparatus, system or method in accordance with this patent specification, all appropriate regulatory, safety, technical, industry and other requirements, guidelines and safety procedures should be consulted and complied with, and the assistance of a qualified, competent personnel experienced in the appropriate fields obtained. Caution must be taken in manufacturing, handling, assembling, using, and disassembling any apparatus or system made or used in accordance with this patent specification.

What is claimed is:

1. A downhole tool useful for extracting fluid from a subsurface formation penetrated by a wellbore surrounded by a layer of contaminated fluid, the subsurface formation having virgin fluid therein beyond the layer of contaminated fluid, the downhole tool comprising:

at least two packers carried by the downhole tool, the at least two packers capable of sealingly engaging the sidewall of the wellbore whereby an isolated portion of the wellbore therebetween is fluidly isolated from a remainder of the wellbore;

a plurality of intakes positioned along the downhole tool between the packers; and at least one pump operatively connected to the plurality of intakes for selectively drawing fluid into one or more specific intakes of the plurality of intakes whereby the virgin fluid is collected in the downhole tool.

2. The downhole tool of claim 1 further comprising at least one flow line in fluid communication with each of the plurality of intakes, the at least one flow line operatively connected to the at least one pump for drawing fluid into the downhole tool.

3. The downhole tool of claim 2 wherein the at least one flow line is adapted to pass at least a portion of the fluid from the plurality of intakes into the wellbore.

4. The downhole tool of claim 2 further comprising at least one valve and at least one corresponding sample chamber connected to the at least one flowline for selectively diverting samples of at least a portion of the fluid from the at least one flowlines into the at least one sample chamber.

5. The downhole tool of claim 2 wherein each at least one flow line is connected to the same pump.

6. The downhole tool of claim 2 wherein the at least one flow line comprises a plurality of flow lines, each of the plurality of flowlines being connected to a separate pump.

7. The downhole tool of claim 1 further comprising a fluid monitor adapted to measure fluid parameters of the fluid in the at least one flowline.

8. The downhole tool of claim 7 wherein the fluid monitor is an optical fluid analyzer capable of measuring optical density of the fluid.

9. The downhole tool of claim 7 further comprising a controller adapted to receive data from the fluid monitor and send command signals in response thereto.

10. The downhole tool of claim 9 wherein the controller is capable of sending command signals for selectively adjusting the flow of fluid into the plurality of intakes in response to the fluid parameters.

11. A method of sampling virgin fluid from a subterranean formation penetrated by a wellbore surrounded by contaminated fluid, the subterranean formation having virgin fluid therein, the method comprising:

positioning a downhole tool in the wellbore adjacent the subterranean formation, the downhole tool having a pair of expandable packers with a plurality of intakes positioned along the downhole tool between the packers and adapted to draw fluid therein;

isolating a portion of the wellbore using the expandable packers;

establishing fluid communication between the plurality of intakes and the formation; and selectively drawing at least a portion of the virgin fluid through one or more specific intakes of the plurality of intakes and into the downhole tool.

12. The method of claim 11 wherein the step of positioning comprises positioning a downhole tool in the wellbore adjacent the subterranean formation, the plurality of intakes adapted to draw fluid therein and the at least one pump operatively connected thereto for drawing fluid into the plurality of intakes, the method further comprising optimizing the flow of virgin fluid into the downhole tool by selectively adjusting the flow of fluid through the plurality of intakes and into the downhole tool.

13. The method of claim 11 further comprising monitoring parameters of the fluid passing through the intakes.

14. The method of claim 13 further comprising determining the optimum flow for the intakes based on the parameters.

15. The method of claim 11 further comprising sending command signals in response to the fluid parameters for performing wellbore functions.

* * * * *